US006508631B1

(12) United States Patent
Smith et al.

(10) Patent No.: US 6,508,631 B1
(45) Date of Patent: Jan. 21, 2003

(54) RADIAL FLOW TURBOMOLECULAR VACUUM PUMP

(75) Inventors: Donald K. Smith, Belmont, MA (US); Matthew M. Besen, Andover, MA (US)

(73) Assignee: MKS Instruments, Inc., Andover, MA (US)

( * ) Notice: Subject to any disclaimer, the term of this patent is extended or adjusted under 35 U.S.C. 154(b) by 0 days.

(21) Appl. No.: 09/442,712

(22) Filed: Nov. 18, 1999

(51) Int. Cl.[7] ..... F04B 49/06
(52) U.S. Cl. ..... 417/44.2; 415/90
(58) Field of Search ..... 417/44.2, 423.4, 417/53; 415/90, 55.3, 55.6, 100, 71; 416/4

(56) References Cited

U.S. PATENT DOCUMENTS

| | | | | |
|---|---|---|---|---|
| 3,584,966 A | * | 6/1971 | Osterstrom | 415/100 |
| 3,749,528 A | | 7/1973 | Rousseau et al. | 417/424 |
| 3,832,084 A | | 8/1974 | Maurice | 415/90 |
| 4,082,376 A | | 4/1978 | Wehde et al. | 308/10 |
| 4,252,185 A | | 2/1981 | Kosson | 165/105 |
| 4,375,937 A | | 3/1983 | Cooper | 415/53 R |
| 4,502,832 A | | 3/1985 | Becker | 415/10 |
| 4,622,687 A | | 11/1986 | Whitaker et al. | 378/130 |
| 5,108,257 A | | 4/1992 | Fukazawa et al. | 415/182.1 |
| 5,118,251 A | | 6/1992 | Saulgeot | 415/90 |
| 5,158,426 A | | 10/1992 | Casaro et al. | 415/52.1 |
| 5,238,362 A | | 8/1993 | Casaro et al. | 415/90 |
| 5,261,793 A | | 11/1993 | Piltingsrud | 417/53 |
| 5,387,079 A | | 2/1995 | Levi | 415/90 |
| 5,456,575 A | | 10/1995 | Helmer et al. | 415/55.1 |
| 5,482,430 A | | 1/1996 | Hablanian | 415/90 |
| 5,522,694 A | | 6/1996 | Bernhardt et al. | 415/14 |
| 5,547,338 A | | 8/1996 | Conrad et al. | 415/90 |
| 5,582,505 A | | 12/1996 | Warth | 415/116 |
| 5,655,895 A | | 8/1997 | Warth et al. | 417/391 |
| 5,667,363 A | | 9/1997 | Bernhardt et al. | 417/44.1 |
| 5,676,522 A | | 10/1997 | Pommel et al. | 415/181 |
| 5,688,106 A | | 11/1997 | Cerruti et al. | 415/90 |
| 5,695,316 A | | 12/1997 | Schutz et al. | 415/90 |
| 5,697,767 A | | 12/1997 | Bissell et al. | 417/350 |
| 5,730,580 A | | 3/1998 | Japikse | 415/208.3 |
| 5,772,404 A | | 6/1998 | Carella et al. | 417/51 |
| 5,848,873 A | * | 12/1998 | Schofield | 415/90 |
| 5,893,702 A | * | 4/1999 | Conrad et al. | 415/71 |
| 6,109,864 A | * | 8/2000 | Schofield et al. | 415/90 |
| 6,135,709 A | * | 10/2000 | Stones | 415/90 |

FOREIGN PATENT DOCUMENTS

| | | | |
|---|---|---|---|
| JP | 3-237295 A | 10/1991 | F04D/19/04 |
| JP | 3-237296 A | 10/1991 | F04D/19/04 |

OTHER PUBLICATIONS

Piltingsrud, "*Miniature Peristaltic Vacuum Pump For Use In Portable Instruments*" J. Vac.Sci.Technol. A 14(4), Jul./Aug. 1996, pp. 2610–2617.

Henning, "*Thirty Years of Turbomolecular Pumps: A Review and Recent Developments*" J.Vac.Sci.Technol. A 6(3), May/Jun. 1988, pp. 1196–1201.

Dushman, "*Scientific Foundations of Vacuum Technique*" pp. 126–159 ©1949.

* cited by examiner

*Primary Examiner*—Teresa Walberg
*Assistant Examiner*—Quang Van
(74) *Attorney, Agent, or Firm*—Kurt Rauschenbach; Rauschenbach Patent Law Group

(57) ABSTRACT

A radial flow turbomolecular vacuum pump includes a gas inlet, a gas outlet, a rotor, and a stator. The rotor includes a first rotor surface that is positioned in a substantially radial direction. A plurality of blades extends from the first rotor surface in a substantially axial direction. The stator includes a first stator surface that is positioned proximate to the first rotor surface in the substantially radial direction. A first and second plurality of vanes extend from the first stator surface and generally forms an annulus therebetween for receiving the first plurality of blades. A drive shaft is coupled to the rotor and positioned in the substantially axial direction. A motor is coupled to the drive shaft and rotates the rotor relative to the stator. The rotation of the rotor relative to the stator causes gas to be pumped from the gas inlet to the gas outlet in the substantially radial direction.

32 Claims, 7 Drawing Sheets

RADIAL FLOW TURBOMOLECULAR VACUUM PUMP

FIELD OF THE INVENTION

The invention relates generally to the field of vacuum pumps and compressors. In particular, the present invention relates to radial flow turbomolecular vacuum pumps and methods for operating radial flow pumps.

BACKGROUND OF THE INVENTION

Prior art vacuum pumping systems are typically continuous flow compression systems that evacuate gas from a vacuum chamber at low pressure, for example $10^{-6}$ torr, and then compress the gas to atmospheric pressure so that the gas may be discharged to the atmosphere. Such prior art pumping systems would typically include a high vacuum pump, such as a turbomolecular pump or a diffusion pump, capable of evacuating to high vacuum. This pump would be followed by a fore pump such as an oil sealed rotary pump or a diaphragm pump, which would further compress the gas and exhaust the gas to the atmosphere.

Vacuum pumps are used for numerous applications including vacuum based instrumentation, such as mass spectrometers, electron microscopes, and various surface analysis tools that use ion or electron beams. Such vacuum based instruments are typically designed for use in dedicated laboratories because of the size, weight, and service requirements of the vacuum pump and other hardware. Consequently, analysis is typically performed by transporting the material to be analyzed to a dedicated laboratory facility. Unfortunately, not all materials that require analysis can be conveniently transported. There is a significant need for portable vacuum based analysis equipment that can be transported to the location of the analysis.

Attempts to produce portable vacuum based instruments have had only limited success because it is difficult to achieve the required pumping capacity with a compact pump design. Also, some prior art pumping designs, such as diffusion and oil sealed pump designs, are sensitive to operating position and have service requirements that are inconsistent with general requirements for portable pumps. Prior art turbomolecular pumps must have a substantially large axial dimension in order to have acceptable pumping efficiency. Other prior art vacuum pumps, such as diaphragm type pumps, require several compression stages which adds to their size, weight and power requirement.

Many prior art portable instruments use storage-type vacuum pumps. Storage vacuum pumps include ion pumps, getter pumps and sorption pumps. These pumps operate by capturing gas molecules within the pump and storing them. The molecules are stored up to some capacity limit of the pump and then the pump must be discarded or reprocessed, which is both inconvenient and expensive.

Storage-type vacuum pumps have numerous disadvantages. Storage-type vacuum pumps have poor pumping speed for certain gases. They are also difficult to restart after a shutdown. In addition, if the pumps store toxic gases, there is a danger of poisoning the user if the pump malfunctions. Notwithstanding the disadvantages of storage type vacuum pumps, these pumps are only slightly smaller than the compression type pumps.

In addition, laboratory space, especially in the semiconductor industry, is very costly and not easily expandable and reconfigurable. There is also a significant need for compact instruments that reduce the size, weight and service requirements of analysis equipment used in laboratories. In addition, there is a need for compact add-on instruments that do not significantly increase the footprint of existing laboratory equipment so as to avoid reconfiguring a laboratory.

SUMMARY OF THE INVENTION

The present invention relates to compact vacuum pumps that can be used in instrumentation where the application may be portable, hand held or space limited. A principal discovery of the present invention is that an efficient compact turbomolecular vacuum pump can be constructed having a radial flow design where the dimension of the gas flow path in the radial direction is greater than the dimension of the gas flow path in the axial direction.

Accordingly, in one embodiment, the present invention features a radial turbomolecular vacuum pump that includes a gas inlet, a gas outlet, a rotor, and a casing. The rotor includes a first rotor surface that is positioned in a substantially radial direction. A first plurality of blades extends from the first rotor surface in a substantially axial direction. In one embodiment, at least one blade of the first plurality of blades is shaped to increase pumping efficiency. A support ring that reduces deflection due to centrifugal force may be positioned around at least one blade of the plurality of blades. The rotor and at least one blade of the first plurality of blades may be integrally formed from one piece of material.

In one embodiment, the first rotor surface may include at least one cavity that is dimensioned to receive and to retain at least one blade of the first plurality of blades. The at least one blade of the first plurality of blades may include a dovetail and the at least one cavity may be adapted to receive the dovetail. The dovetail may be oriented in a substantially radial direction or in a substantially circumferentially direction.

In one embodiment, the casing includes a first stator surface that is positioned proximate to the first rotor surface in the substantially radial direction. In another embodiment, the stator is separate from the casing. A first and second plurality of vanes extend from the first stator surface and generally forms an annulus therebetween for receiving the first plurality of blades. The annulus may be a groove. At least one vane of the first and second plurality of vanes and the first stator surface may be integrally formed from one piece of material. The stator may include at least one cavity that is dimensioned to receive and retain at least one of the vanes of the first and second plurality of vanes.

In one embodiment, a drive shaft is coupled to the rotor and is positioned in the substantially axial direction. A motor is coupled to the drive shaft and rotates the rotor relative to the stator. In another embodiment, the rotor is directly coupled to the motor without the use of a drive shaft. The rotation of the rotor relative to the casing causes gas to be pumped from the gas inlet to the gas outlet. A fore pump such as a mechanical pump is typically coupled to the gas outlet. In one embodiment, a processor is electrically coupled to the motor and to a pressure sensor that is positioned in fluid communication with the pump. The pressure sensor generates a signal that is proportional to a pressure achieved by the pump and the processor generates a signal that controls a speed of the motor in response to the pressure.

In one embodiment, the vacuum pump further includes a second rotor surface that is positioned in a substantially radial direction. A second plurality of blades extends from the second rotor surface in a substantially axial direction opposite that of the first plurality of blades. A second stator surface is positioned proximate to the second rotor surface in the substantially radial direction. A third and fourth plurality of vanes extend from the second stator surface and generally forming an annulus therebetween for receiving the second plurality of blades.

In another embodiment, the rotor and stator further comprise a second stage. The second stage includes a rotor surface that is positioned in a substantially radial direction. A plurality of blades extends from the rotor surface in a substantially axial direction. The second stage includes a stator surface that is positioned proximate to the second stage rotor surface in the substantially radial direction. A first and second plurality of vanes extend from the stator surface of the second stator and generally form an annulus therebetween for receiving the plurality of blades.

The present invention also features a method for pumping a gas that includes the step of rotating a plurality of substantially axially disposed blades relative to a first and second plurality of vanes that generally form an annulus therebetween for receiving the first plurality of blades. The relative motion of the plurality of blades and the first and second plurality of vanes causes gas to be pumped in a substantially radial direction from a gas inlet to a gas outlet. The gas may be pumped outwardly or inwardly in a substantially radial direction.

In one embodiment, method for pumping a gas further includes rotating a second plurality of substantially axially disposed blades relative to a third and fourth plurality of vanes that generally form an annulus therebetween for receiving the second plurality of blades. The relative motion of the second plurality of blades and the third and fourth plurality of vanes causes gas to be pumped in a substantially radial direction from a gas inlet to a gas outlet. The gas may be pumped outwardly or inwardly in a substantially radial direction.

BRIEF DESCRIPTION OF THE DRAWINGS

This invention is described with particularity in the appended claims. The above and further advantages of this invention may be better understood by referring to the following description taken in conjunction with the accompanying drawings, in which:

DETAILED DESCRIPTION

Figure 1:
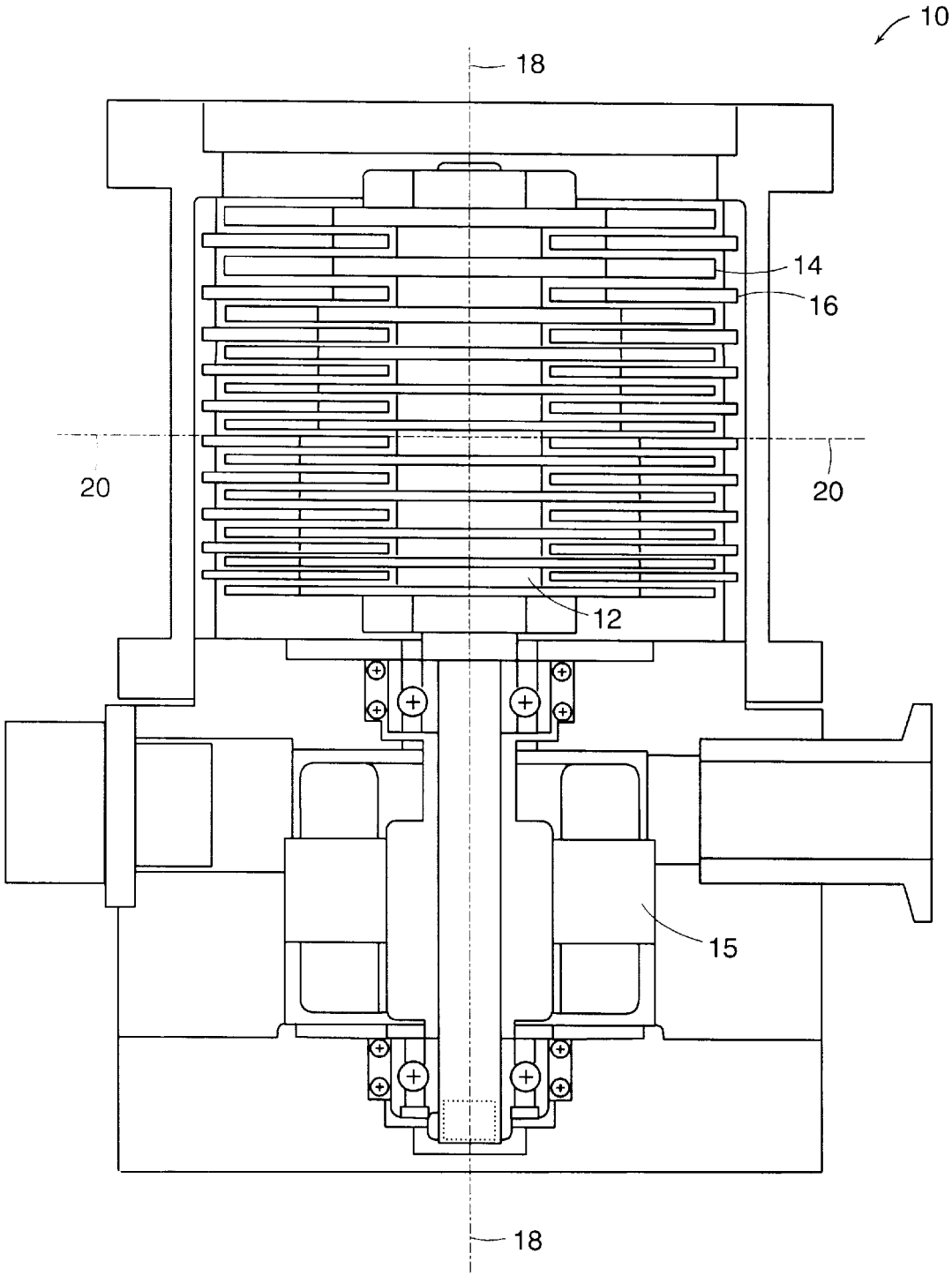
FIG. 1 PRIOR ART
FIG. 1 illustrates a prior art turbomolecular pump design.

FIG. 1 illustrates a prior art axial flow turbomolecular pump 10. The pump 10 includes a rotor 12 having a plurality of axial blades 14. A plurality of stator vanes 16 is positioned to receive the plurality of axial blades 14. A motor 15 drives the rotor 12 so that each of the plurality of blades 14 passes though a respective one of the plurality of stator vanes 16. Compression is achieved in a direction that is substantially parallel to an axial centerline 18. That is, the dimension of the gas flow path parallel the axial centerline 18 is much greater than the dimension of the gas flow path parallel to a radial centerline 20. Many stages of rotor blades and stator vanes are required to achieve the necessary compression and pumping speed. Typically prior art pumping speeds in liters/sec are approximately 50 to 1000 l/sec.

Efficient operation of the prior art axial flow turbomolecular pumps are achieved by rotating the rotor 12 at relatively high speed. Typical prior art axial flow turbomolecular pumps are designed to rotate the rotor 12 so that a blade tip speed is approximately 400 m/sec. In order to achieve this blade tip speed with currently available bearings and motors, the rotor diameter is sized to greater than approximately 75 mm. The dimension of the rotor diameter typically sets the minimum diameter for the pump assembly.

Figure 2A:
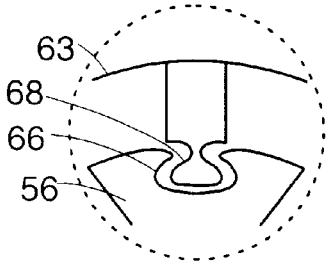
FIG. 2 illustrates one embodiment of a radial flow turbomolecular vacuum pump of the present invention.
Figure 2:
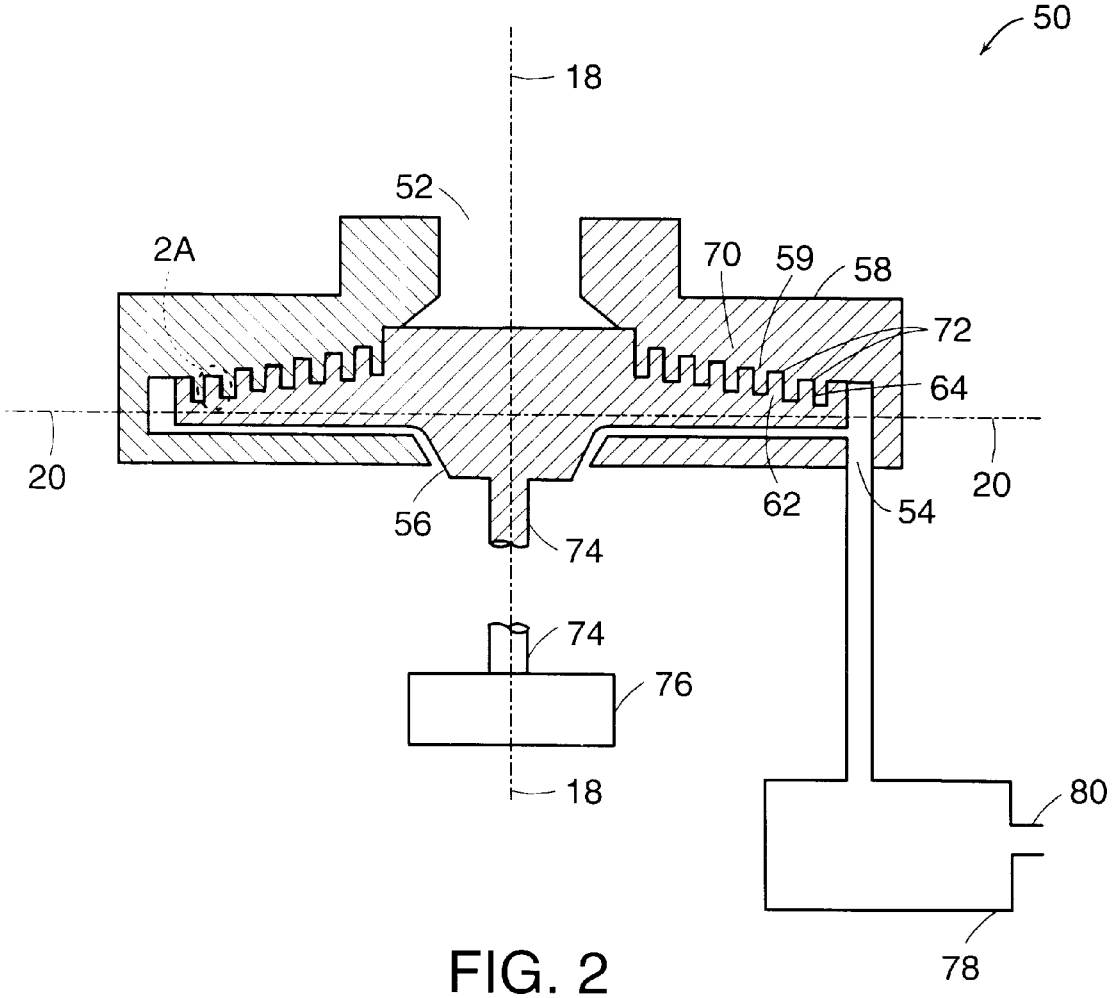

FIG. 2 illustrates one embodiment of a radial flow turbomolecular vacuum pump 50 of the present invention. By radial flow we mean that the dimension of the gas flow path parallel to the radial centerline 20 is greater than the dimension of the gas flow path parallel to the axial centerline 18. The pump 50 includes a gas inlet 52, a gas outlet 54, a rotor 56, and a casing 58. A sensor may be in fluidic communication with the gas inlet 52 or the gas outlet 54.

The rotor 56 includes a first rotor surface 62 that is positioned in a substantially parallel direction to the radial centerline 20. The rotor 56 may be formed from a high strength aluminum alloy. A first plurality of blades 64 extends from the first rotor surface 62 in a substantially parallel direction to the axial centerline 18. In one embodiment, at least one blade of the first plurality of blades 64 is shaped to increase pumping efficiency. A support ring 63 that reduces deflection due to centrifugal force may be positioned around at least one blade of the plurality of blades. In one embodiment, one side of the rotor comprises a molecular drag pump.

The first plurality of blades 64 can be attached to the rotor 56 by numerous means known in the art. In one embodiment, the rotor 56 and at least one blade of the first plurality of blades 64 is integrally formed from one piece of material. In another embodiment, the blades are mounted onto the rotor. The first rotor surface 62 includes at least one cavity 66 that is dimensioned to receive and to retain at least one blade of the first plurality of blades 64. The at least one blade of the first plurality of blades 64 may include a dovetail 68 and the at least one cavity 66 may be adapted to receive the dovetail 68. The dovetail 68 may be oriented in the radial direction or in the circumferential direction.

A stator 59 includes a first stator surface 70 that is positioned proximate to the first rotor surface 62 parallel to the radial centerline 20. In one embodiment, the stator 59 is formed in the casing 58. A first and second plurality of vanes 72 extend from the first stator surface 70 and generally form an annulus therebetween for receiving the first plurality of blades 64. The annulus may be a groove. In one embodiment, a space between at least one blade of the first plurality of blades 64 and the first and second plurality of vanes 72 is approximately 0.2 mm. At least one vane of the first and second plurality of vanes 72 and the first stator surface 70 may be integrally formed from one piece of material. Alternatively, the stator may include at least one cavity that is dimensioned to receive and retain at least one of the vanes.

In one embodiment, a drive shaft 74 is coupled to the rotor 56 and is positioned in the axial direction 18. A motor 76 is coupled to the drive shaft 74 and rotates the rotor 56 relative to the casing 58. In another embodiment, the rotor 56 is directly coupled to the motor 76 without the use of a drive shaft. For example, permanent magnets (not shown) can be embedded in the rotor 56 and driven by stator coils (not shown) positioned in the facing surface. Alternatively, magnetic bearings can be used to levitate the rotor 56.

In one embodiment, the motor is a brushless DC motor and the speed of the motor 76 is approximately 50,000 to 150,000 RPM. The rotation of the rotor 56 relative to the casing 58 causes gas to be pumped radially outward away from the axial centerline 18 or radially inward toward the axial centerline 18, depending on the sense of rotation, from the gas inlet 52 to the gas outlet 54.

A fore pump 78, such as a scroll pump, is typically coupled in series with the gas outlet 54. A molecular drag pump can also be used. The radial flow turbomolecular vacuum pump 50 and the fore pump 78 connected in series pump gases from a high vacuum chamber attached to the gas inlet 52 and exhaust them through a vent 80 to the 10 atmosphere.

One advantage of the radial flow turbomolecular vacuum pump 50 of the present invention is that the axial dimension of the pump is much less than the axial dimension of prior art axial flow turbomolecular vacuum pumps because the compression is achieved radially. The radial flow turbomolecular vacuum pump 50 of the present invention is particularly efficient for low pumping speeds, less than 50 liters/sec.

Figure 3A:
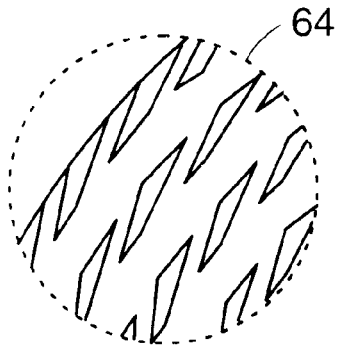
FIG. 3 illustrates an axial view of the rotor used in the radial flow turbomolecular vacuum pump of the present invention.
Figure 3:
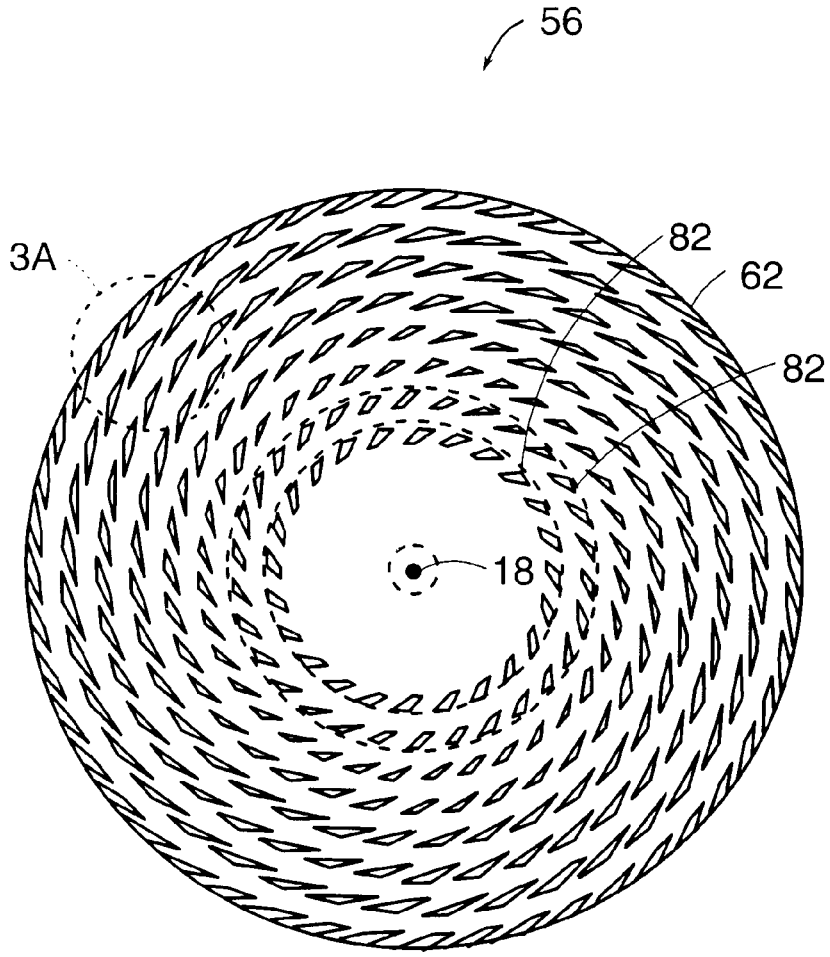

FIG. 3 illustrates an axial view of the rotor 56 used in the radial flow turbomolecular vacuum pump 50 of the present invention. The rotor 56 comprises the first rotor surface 62 and the first plurality of blades 64 that extends from the first rotor surface in the axial direction 18. The first plurality of blades 64 are arranged in corresponding concentric rings 82. The first and second plurality of vanes (not shown) are arranged in concentric stator rings between the concentric rings 82 of first plurality of blades 64. The gas flow moves radially from one concentric ring of blades, through a corresponding concentric stator ring and then to the next concentric ring of rotor blades and stator blades. One advantage of the rotor 56 of the present invention is that the rotor 56 can be machined from one side in one machining operation, which reduces the manufacturing cost of the pump 50.

The first plurality of blades 64 are shaped and positioned to achieve a certain pumping speed, compression, and efficiency. The pitch of each blade of the first plurality of blades 64 generally determines the pumping speed and compression. For example, tilting the blades towards the radial direction 20, will generally result in a higher pumping speed. Tilting the blades towards the circumferential direction, will result in higher compression, which generally results in lower pumping speed.

In one embodiment, the inner blades (blades closest to the axial centerline 18) are gradually tilted towards the radial direction for high pumping speed and the outer blades (blades farthest from the axial centerline 18) are gradually tilted towards the circumferential direction for higher compression. In this embodiment, as the gas is compressed, there is more pumping in the blades furthest from the axial centerline 18, therefore achieving higher compression.

Figure 4:
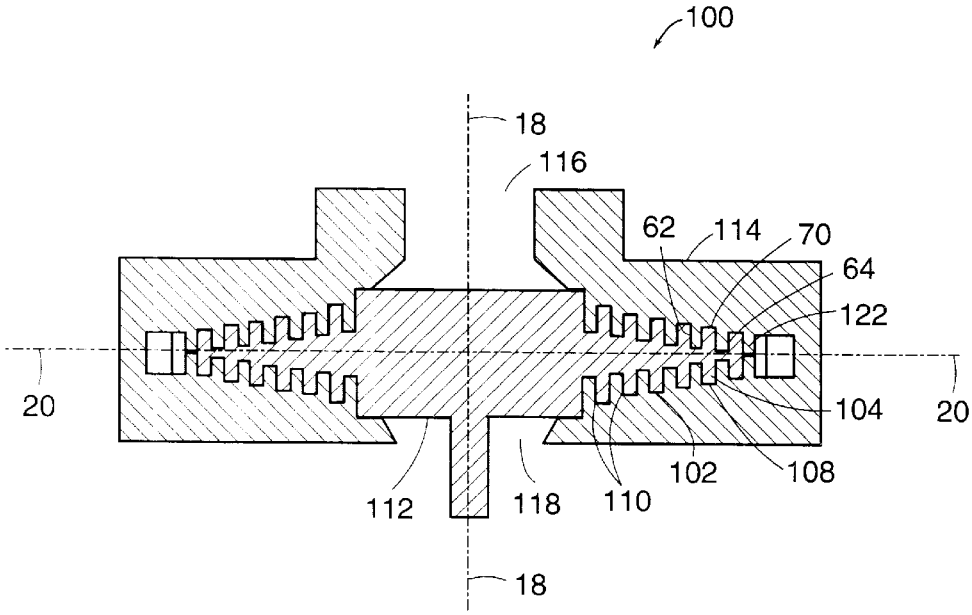
FIG. 4 illustrates a radial flow turbomolecular vacuum pump according to the present invention having rotor blades extending from two surfaces.

FIG. 4 illustrates a radial flow turbomolecular vacuum pump 100 according to the present invention having rotor blades extending from two surfaces. The pump 100 is similar to the turbomolecular vacuum pump 50 of FIG. 2. The pump 100 further includes a second rotor surface 102 that is positioned in the radial direction 20. A second plurality of blades 104 extends from the second rotor surface 102 in the axial direction 18 opposite that of a first plurality of blades 64.

A second stator surface 108 is positioned proximate to the second rotor surface 102 in the radial direction 20. A third and fourth plurality of vanes 110 extend from the second stator surface 108 and generally form an annulus therebetween for receiving the second plurality of blades 104. The rotation of a rotor 112 relative to a casing 114 causes gas to be pumped radially outward away from the axial centerline 18 or radially toward the axial centerline 18, depending on the sense of rotation, from a gas inlet 116 to the gas outlet 118.

In one embodiment, the first 70 and the second stator surface 108 pump in parallel to achieve a higher pump speed. That is, the gas is pumped radially outward or radially inward on both the first 62 and the second rotor surface 102. In another embodiment, the first 70 and the second stator surface 108 pump in series to achieve increased compression. That is, the gas is pumped radially outward on one of the first 62 and second rotor surface 102 and radially inward on the other of the first 64 and second rotor surface 102.

Figure 5:
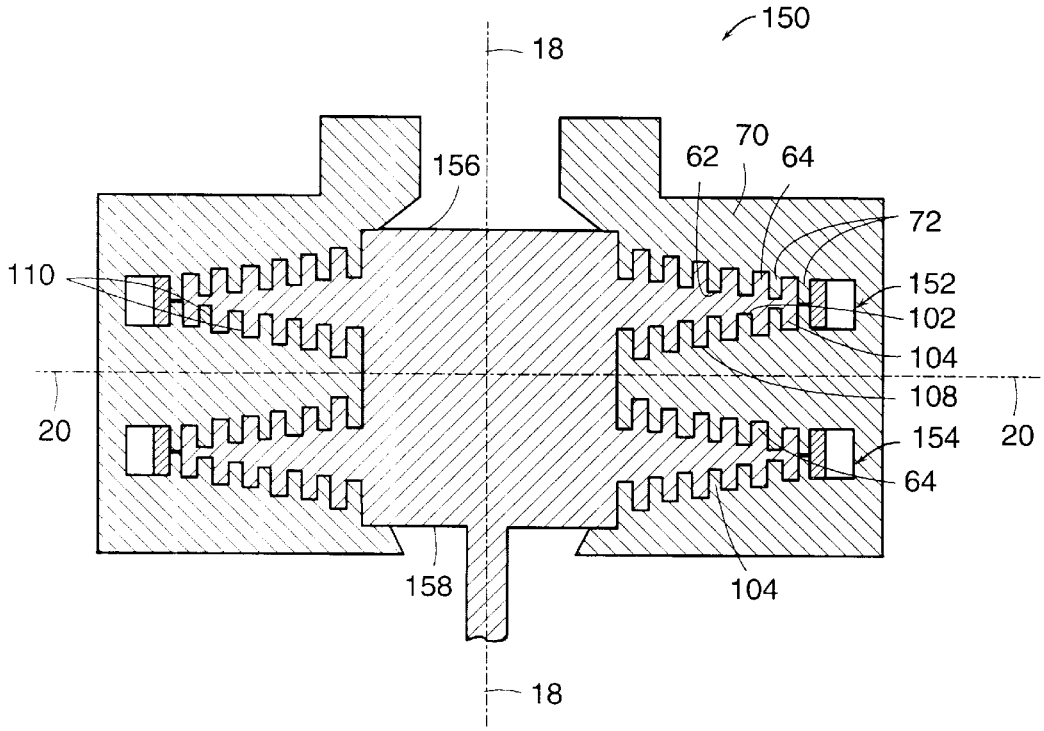
FIG. 5 illustrates an embodiment of a radial flow turbomolecular vacuum pump according to the present invention having a second stage.

FIG. 5 illustrates an embodiment of a radial flow turbomolecular vacuum pump 150 according to the present invention having a first 152 and a second stage 154. The pump 150 is similar to the turbomolecular vacuum pump 50 of FIG. 4, but includes a first 156 and a second rotor 158, each having a first 62 and a second rotor surface 102. A first 64 and second plurality of blades 104 extends from the first rotor 156 in the axial direction 18. A first 64 and second plurality of blades 104 extend from the second rotor 158 in the axial direction 18. A first 70 and a second stator surface 108 is positioned proximate to the first 62 and the second rotor surface 102, respectively, in the radial direction 20. A first and second plurality of vanes 72 extend from the first stator surface 70 and generally form an annulus therebetween for receiving the first plurality of blades 64. A third and fourth plurality of vanes 110 extend from the second stator surface 108 and generally form an annulus therebetween for receiving the second plurality of blades 104.

In one embodiment, the first 152 and the second stages 154 are configured to pump in series to achieve increased compression. That is, the gas is pumped radially outward or radially inward, depending on the sense of the rotation, in both the first 152 and second stage 154. In another embodiment, the first 152 and the second stage 154 are configured to pump in parallel to achieve a higher pumping speed. That is, the gas is pumped radially outward in one stage and radially inward in the other stage. Other embodiments of the turbomolecular vacuum pump the present invention includes more than two stages to achieve additional compression or additional pumping speed.

Figure 6:
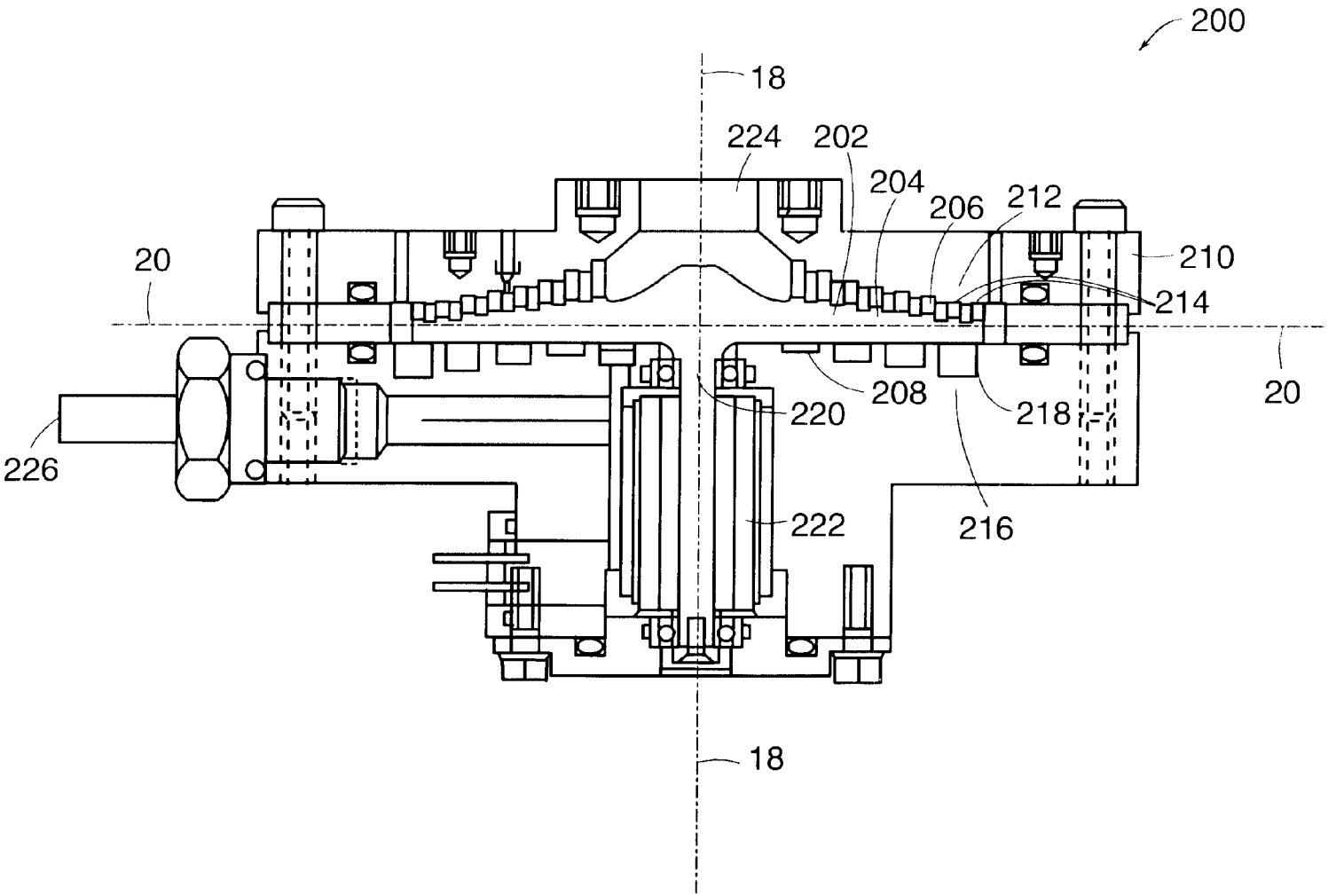
FIG. 6 illustrates a sectional view of an embodiment of a radial flow turbomolecular vacuum pump according to the present invention having a spiral groove.

FIG. 6 illustrates a sectional view of an embodiment of a radial flow turbomolecular vacuum pump 200 according to the present invention. The turbomolecular vacuum pump 200 includes a rotor 202 having a first rotor surface 204 that is positioned in the substantially radial direction 20. A first plurality of blades 206 extends from the first rotor surface 204 in the substantially axial direction 18. The rotor 202 includes a second rotor surface 208 that is positioned in the substantially radial direction 20. The second rotor surface 208 is substantially smooth (i.e. does not have any blading).

The vacuum pump 200 has a casing 210 which includes a first stator surface 212 that is positioned proximate to the first rotor surface 204 in the radial direction 20. A first and second plurality of vanes 214 extends from the first stator surface 212 and generally forms an annulus therebetweeen for receiving the first plurality of blades 206. At least one vane of the first and second plurality of vanes 214 and the first stator surface 212 may be integrally formed from one piece of material. The casing 210 may include at least one cavity that is dimensioned to receive and retain at least one of vane of the first and second plurality of vanes 214.

The casing 210 includes a second stator surface 216. The second stator surface 216 forms a continuous spiral groove 218 of decreasing area moving toward the axial center line 18. In one embodiment, the spiral shaped pattern encircles the axial center line 18 of the pump 200 three to five times. The spiral groove 218 acts as a Siegbahn type drag pump, which increases the pressure of the gas as the gas moves along the spiral groove 218 toward to the axial center line 18.

The vacuum pump 200 has a drive shaft 220 coupled to the rotor 202 and is positioned in the axial direction 18. A motor 222 is coupled to the drive shaft 220 and rotates the rotor 202 relative to the casing 210. The rotation of the rotor 202 relative to the casing 210 causes gas to be pumped from a gas inlet 224 to a gas outlet 226. Gas is pumped from the gas inlet 224, through the first rotor surface 204 and first stator surface 212 in a radially outward direction. The gas is then pumped along the second stator surface 216 through the spiral groove 218 toward the centerline 18. The gas is then pumped through to the gas outlet 226.

Figure 7:
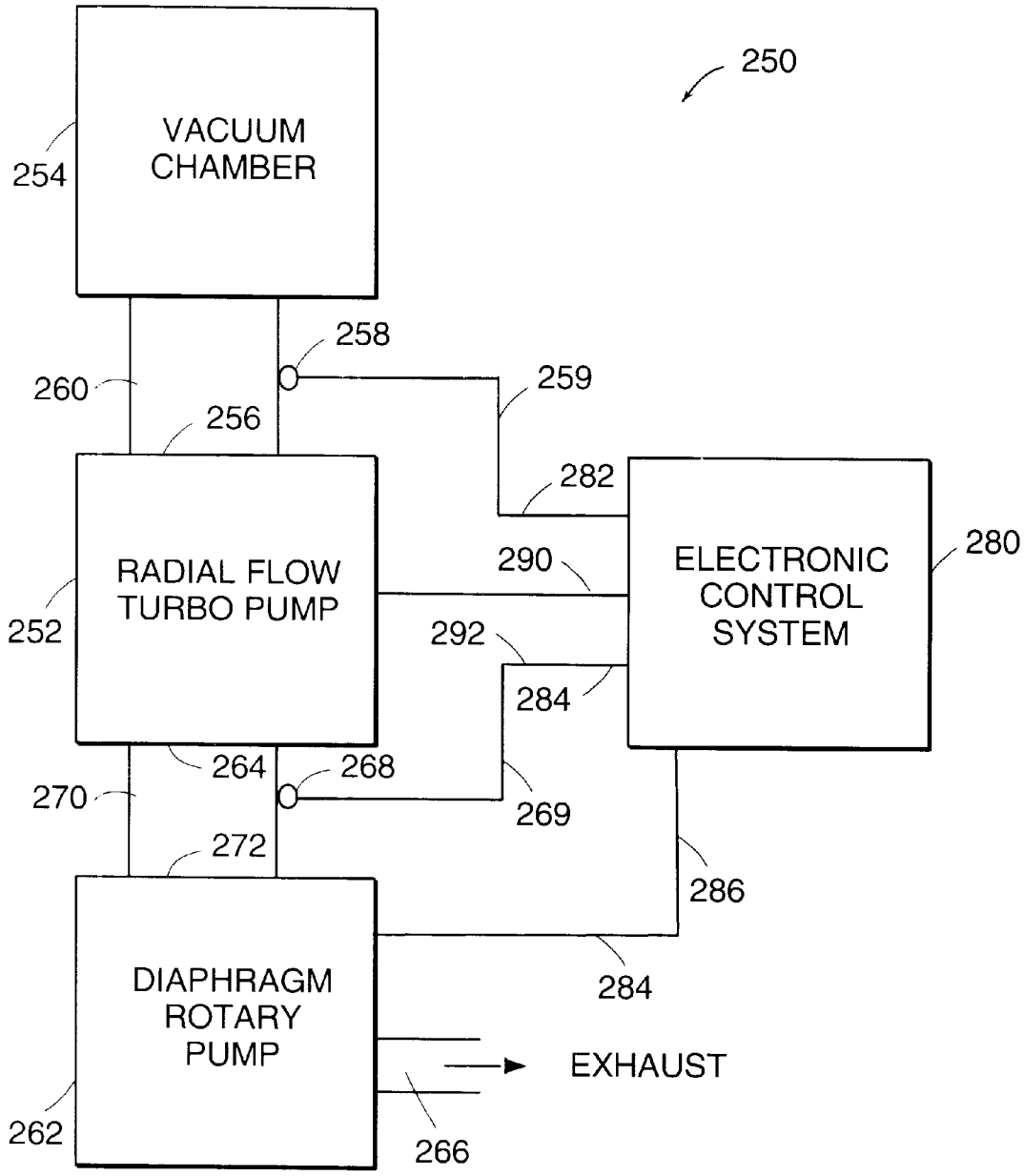
FIG. 7 illustrates a functional block diagram of a compact pumping system that includes a radial flow turbomolecular vacuum pump according to the present invention.

FIG. 7 illustrates a functional block diagram of a compact pumping system 250 that includes a radial flow turbomolecular vacuum pump 252 according to the present invention. The system includes a vacuum chamber 254 that is in fluid communication with an input 256 to the radial flow turbomolecular vacuum pump 252. A first pressure sensor 258 is positioned in a conduit 260 between the vacuum chamber 254 and the turbomolecular vacuum pump 252. The first pressure sensor 258 generates an electrical signal at an output 259 that is proportional to the pressure at the input 256 to the turbomolecular vacuum pump 252.

A fore pump 262 is coupled in fluid communication with an exhaust port 264 of the radial flow turbomolecular vacuum pump 252. The fore pump 262 compresses the gas exhausted from turbomolecular vacuum pump 252 from approximately 0.01 to 1.0 torr and exhausts the gas at atmospheric pressure at an outlet 266. In one embodiment, the fore pump 262 comprises a scroll pump. In another embodiment, the fore pump 262 comprises a diaphragm sealed rotary pump. Both scroll pumps and diaphragm sealed rotary pump are compatible with the turbomolecular vacuum pump 252 of the present invention and suitable for a compact pumping system because they are relatively small and are oil free.

A second pressure sensor 268 is positioned in a conduit 270 between the exhaust port 264 of the turbomolecular vacuum pump 252 and an input 272 to the fore pump 262. The second pressure sensor 268 generates an electrical signal at an output 269 that is proportional to the pressure at the input 272 to the fore pump 262. The compact pumping system 250 may also include other sensors such as temperature, rotor rotation speed, and torque.

An electronic control system 280 controls the operation of the turbomolecular vacuum pump 252 and fore pump 262. A first 259 and second sensor output 269 is electrically coupled to a first 282 and second electrical input 284 to the electronic control system 280. The electronic control system 280 has an electrical output 290 that is electrically coupled to the motor 252 that drives the rotor 56 (FIG. 2) of the turbomolecular vacuum pump 252. The electronic control system 280 also has an electrical output 286 that is electrically coupled to the fore pump 262 that controls the speed of the fore pump 262.

In operation, the electronic control system 280 processes the signals generated by the first 258 and second pressure sensor 268 and produces a signal that controls the speed of the rotor 56. The speed of the rotor 56 (FIG. 2) can be controlled to achieve a certain operating pressure or a certain pumping performance. For example, the control system 280 may be used to adjust the speed of the rotor 56 and the speed of the fore pump 262 to achieve long operating life and operating power consumption.

The compact pumping system 250 provides a high vacuum pumping capability that exhausts gas directly to atmosphere. In one embodiment of the invention, the radial flow turbomolecular pump 252 and fore pump 262 together weigh less than 3 kg and have a volume of less than 2000 $cm^3$.

Figure 8:
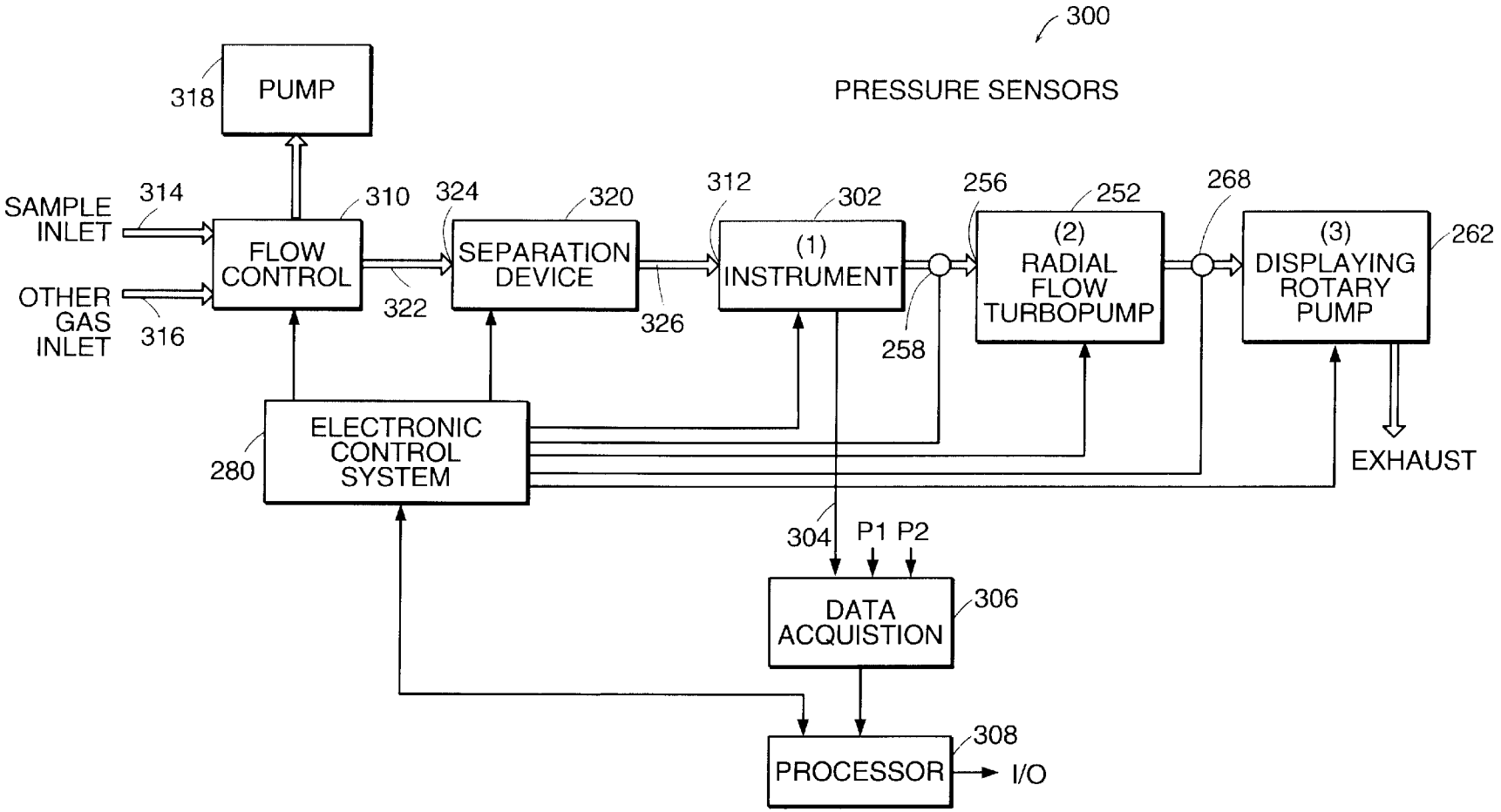
FIG. 8 illustrates an analytic instrument that uses the radial turbomolecular vacuum pump according to the present invention.

FIG. 8 illustrates an analytic instrument 300 that uses the radial turbomolecular vacuum pump according to the present invention. The instrument 300 includes the compact pumping system 250 of FIG. 7 that comprises the radial turbomolecular vacuum pump 252, the fore pump 262, the electronic control system 280, and the first 258 and the second pressure sensor 268.

A vacuum instrument 302 is positioned in fluid communication with the input 256 to the radial flow turbomolecular vacuum pump 252. The instrument 302 has an electrical output 304 that is coupled to a data acquisition unit 306. A processor 308 may be connected to the data acquisition unit 306 to analyze and process the data. In one embodiment, the instrument 302 is a compact mass spectrometer and the instruments generates signals that are indicative of the mass of the ions being generated.

A flow control unit 310 is coupled to an input 312 to the instrument 302. The flow control unit 310 has a sample gas inlet 314 and a carrier gas input 316. A pump 318 may be coupled in fluid communication with the flow control unit 310 to remove excess gas flow from the flow control unit 310. In one embodiment, the pump 318 may be a scroll pump or a diaphragm rotary pump.

In one embodiment, a gas separation unit 320 is positioned between the flow control device 310 and the instrument 302. The gas separation device 320 is used to separate a portion of the sampled gas according to certain characteristics, such as mass range. An output 322 of the flow control unit 310 is positioned in fluid communication with an input 324 of the separation device 320 and an output 326 of the separation device 320 is positioned in fluid communication with the input 312 of the instrument 302.

The electronic control system 280 is electrically coupled to the flow control unit 310, the separation device 320, the instrument 302, the radial turbomolecular vacuum pump 252, the fore pump 262, the processor 308, and the first 258 and the second pressure sensor 268. The electronic control system 280 can control the delivery of the sample gas to the instrument 302, the pressure within the instrument 302 and characteristic of the turbomolecular vacuum pump 252 and the fore pump 262, such as, operating life and operating power consumption.

Equivalents

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A radial turbomolecular vacuum pump comprising:

a) a gas inlet;

b) a rotor comprising:

i) a first rotor surface that is positioned in a substantially radial direction; and ii) a plurality of blades being in fluid communication with the gas inlet and extending from the first rotor surface in a substantially axial direction, the plurality of blades being arranged in concentric rings of blades and being tilted towards the radial direction;

c) a stator comprising:

i) a first stator surface that is positioned proximate to the first rotor surface in the substantially radial direction; and ii) a first and a second plurality of vanes extending from the first stator surface, the first and the second plurality of vanes being arranged in concentric stator rings and being disposed between the concentric rings of the plurality of blades and being tilted towards the radial direction; and d) a gas outlet that is in fluid communication with the plurality of blades and the first and the second plurality of vanes, wherein rotation of the rotor relative to the stator causes gas to be pumped radially from the concentric rings of blades through the concentric stator rings and then to the gas outlet.

2. The vacuum pump of claim 1 wherein at least one blade of the plurality of blades and the first rotor surface are integrally formed from one piece of material.

3. The vacuum pump of claim 1 wherein the first rotor surface further comprises at least one cavity that is dimensioned to receive and to retain at least one blade of the plurality of blades.

4. The vacuum pump of claim 3 wherein at least one blade of the plurality of blades further comprises a dovetail and wherein the at least one cavity is adapted to receive the dovetail.

5. The pump of claim 4 wherein the dovetail is oriented in a substantially radial direction.

6. The vacuum pump of claim 4 wherein the dovetails oriented in a substantially circumferential direction.

7. The vacuum pump of claim 1 wherein at least one blade of the plurality of blades is shaped to increase pumping efficiency.

8. The vacuum pump of claim 1 wherein at least one vane of the first and second plurality of vanes and the first stator surface are integrally formed from one piece of material.

9. The vacuum pump of claim 1 wherein the first stator surface includes at least one cavity that is dimensioned to receive and retain at least one of the first and the second plurality of vanes.

10. The vacuum pump of claim 1 further comprising:

a) a second rotor surface that is positioned in a substantially radial direction;

b) a second plurality of blades extending from the second rotor surface in a substantially axial direction, the second plurality of blades being arranged in concentric rings of blades and being tilted towards the radial direction;

c) a second stator surface that is positioned proximate to the second rotor surface in the substantially radial direction; and d) a third and a fourth plurality of vanes extending from the second stator surface, the third and the fourth plurality of vanes being arranged in concentric stator rings and being disposed between the concentric rings of the plurality of blades and being tilted towards the radial direction.

11. The vacuum pump of claim 1 further comprising:

a) a drive shaft coupled to the rotor and positioned in the substantially axial direction; and b) a motor coupled to the drive shaft for rotating the rotor relative to the stator.

12. The vacuum pump of claim 11 further comprising a processor that is electrically coupled to the motor and to a pressure sensor, the pressure sensor being in fluidic communication with the vacuum pump and generating a signal proportional to the pressure experienced by the pressure sensor, the processor generating a signal in response to the signal generated by the pressure sensor that controls a speed of the motor.

13. The vacuum pump of claim 1 wherein:

a) the rotor further comprises a second stage comprising:

i) a rotor surface that is positioned in a substantially radial direction; and ii) a plurality of blades extending from the rotor surface in a substantially axial direction, the plurality of blades being arranged in concentric rings of blades and being tilted towards the radial direction; and b) the stator further comprises a second stage comprising:

i) a stator surface that is positioned proximate to the rotor surface in the substantially radial direction; and ii) a first and a second plurality of vanes extending from the stator surface, the first and the second plurality of vanes being arranged in concentric stator rings and being disposed between the concentric rings of the plurality of blades and being tilted towards the radial direction.

14. The vacuum pump of claim 1 wherein the vacuum pump comprises a compressor for compressing the gas.

15. The vacuum pump of claim 1 wherein the stator is formed in a casing containing the vacuum pump.

16. The vacuum pump of claim 1 further comprising a support ring positioned around at least one blade of the plurality of blades, the support ring reducing deflection of the at least one blade due to centrifugal force.

17. The vacuum pump of claim 1 further comprising a mechanical pump that is coupled to the gas outlet.

18. The vacuum pump of claim 1 wherein a dimension of a gas flow path in the substantially radial direction is greater than a dimension of a gas flow path in the substantially axial direction.

19. A radial turbomolecular vacuum pump comprising:

a) a gas inlet;

b) a rotor comprising:

i) a rotor surface that is positioned in a substantially radial direction; and ii) a plurality of blades being in fluid communication with the gas inlet and extending from the rotor surface in a substantially axial direction, the plurality of blades being arranged in concentric rings of blades and being tilted towards the radial direction;

c) a casing comprising:

i) a first stator surface that is positioned proximate to the first rotor surface in the substantially radial direction; and ii) a first and a second plurality of vanes extending from the first stator surface, the first and the second plurality of vanes being arranged in concentric stator rings and being disposed between the concentric rings of the plurality of blades and being tilted towards the radial direction;

d) a gas outlet that is in fluid communication with the plurality of blades and the first and the second plurality of vanes, wherein rotation of the rotor relative to the casing causes gas to be pumped from the gas inlet radially from the concentric rings of blades through the concentric stator rings and then to the gas outlet; and e) a fore pump coupled to the gas outlet.

20. The radial turbomolecular vacuum pump of claim 19 wherein a dimension of a gas flow path in the substantially radial direction is greater than a dimension of a gas flow path in the substantially axial direction.

21. The radial turbomolecular vacuum pump of claim 19 further comprising a sensor that is in fluidic communication with the gas inlet of the vacuum pump.

22. The radial turbomolecular vacuum pump of claim 19 further comprising an analytical instrument that is in fluidic communication with the gas inlet of the vacuum pump.

23. The radial turbomolecular vacuum pump of claim 22 wherein the analytical instrument comprises a mass spectrometer.

24. The radial turbomolecular vacuum pump of claim 19 wherein a side of the rotor comprises a molecular drag pump.

25. The radial turbomolecular vacuum pump of claim 19 wherein the molecular drag pump comprises a flat spiral groove.

26. The radial turbomolecular vacuum pump of claim 19 wherein the fore pump comprises a scroll pump.

27. A method for pumping a gas with a turbomolecular vacuum pump, the method comprising:

a) receiving the gas through a gas inlet;

b) rotating a plurality blades that are substantially axially disposed and arranged in concentric rings relative to a first and second plurality of vanes arranged in concentric stator rings that are disposed between the concentric rings of the plurality of blades, wherein the relative motion of the plurality of blades and the first and second plurality of vanes causes gas to be pumped in a substantially radial direction from the concentric rings of blades through the concentric stator rings; and c) exhausting the gas through a gas outlet.

28. The method of claim 27 further comprising compressing the gas.

29. The method of claim 27 wherein the gas is pumped outwardly in a substantially radial direction.

30. The method of claim 27 wherein the gas is pumped inwardly in a substantially radial direction.

31. The method of claim 27 further comprising the step of rotating a second plurality of blades that are substantially axially disposed and arranged in concentric rings relative to a third and a fourth plurality of vanes arranged in concentric stator rings, wherein the relative motion of the second plurality of blades and the third and the fourth plurality of vanes causes gas to be pumped in a substantially radial direction from the concentric rings of blades through the concentric stator rings.

32. A radial turbomolecular vacuum pump comprising:

a) means for receiving a gas;

b) means for rotating a plurality blades that are substantially axially disposed and arranged in concentric rings relative to a first and second plurality of vanes arranged in concentric stator rings that are disposed between the concentric rings of the plurality of blades, wherein the relative motion of the plurality of blades and the first and second plurality of vanes causes the gas to be pumped in a substantially radial direction from the concentric rings of blades through the concentric stator rings; and c) means for exhausting the gas through a gas outlet.

* * * * *

UNITED STATES PATENT AND TRADEMARK OFFICE

CERTIFICATE OF CORRECTION

PATENT NO. : 6,508,631 B1
DATED : January 21, 2003
INVENTOR(S) : Donald K. Smith It is certified that error appears in the above-identified patent and that said Letters Patent is hereby corrected as shown below:

Column 11,
Line 28, replace "19" with -- 24 --

Signed and Sealed this

Seventeenth Day of June, 2003

JAMES E. ROGAN
*Director of the United States Patent and Trademark Office*